US009802097B2

(12) United States Patent
Ryan

(10) Patent No.: US 9,802,097 B2
(45) Date of Patent: Oct. 31, 2017

(54) SWING TRAINING SYSTEM AND METHOD

(71) Applicant: Timothy Ryan, Colorado Springs, CO (US)

(72) Inventor: Timothy Ryan, Colorado Springs, CO (US)

( * ) Notice: Subject to any disclaimer, the term of this patent is extended or adjusted under 35 U.S.C. 154(b) by 440 days.

(21) Appl. No.: 14/680,295

(22) Filed: Apr. 7, 2015

(65) Prior Publication Data

US 2016/0296818 A1 Oct. 13, 2016

(51) Int. Cl.

*A63B 69/00* (2006.01)
*A63B 69/36* (2006.01)
*A63B 71/02* (2006.01)

(52) U.S. Cl.

CPC ..... *A63B 69/0024* (2013.01); *A63B 69/3641* (2013.01); *A63B 2071/024* (2013.01); *A63B 2209/08* (2013.01); *A63B 2220/58* (2013.01); *A63B 2220/833* (2013.01)

(58) Field of Classification Search

CPC ..... A63B 69/0024; A63B 69/3641; A63B 2071/024; A63B 2209/08; A63B 2220/58; A63B 2220/833; A63B 69/36; A63B 69/3676; A63B 21/153

See application file for complete search history.

(56) References Cited

U.S. PATENT DOCUMENTS 883,058 A * 3/1908 Sprague ..... A63B 69/0079 473/147
1,137,349 A * 4/1915 Patterson ..... A63B 21/153 473/203
2,858,133 A * 10/1958 Self ..... A63B 69/3676 473/229
3,073,602 A * 1/1963 Bell ..... A63B 69/3676 473/229
3,232,623 A * 2/1966 Abrams ..... A63B 69/3685 473/221
3,966,203 A 6/1976 Bickford
4,535,991 A 8/1985 Boatright
5,158,299 A 10/1992 Otter
5,662,527 A * 9/1997 Jacquinot ..... A63B 69/0079 473/138
5,716,286 A * 2/1998 Swan ..... A63B 21/153 273/DIG. 21
5,816,928 A 10/1998 Colonna
5,957,819 A 9/1999 Cortesi
6,413,196 B1 * 7/2002 Crowson ..... A63B 21/153 273/317
7,708,658 B2 * 5/2010 McInerney ..... A63B 21/153 33/756
7,892,103 B2 2/2011 Vahary
8,137,209 B2 3/2012 Morelli
8,282,500 B1 10/2012 Masching
8,556,785 B1 10/2013 Ihli et al.
2004/0224784 A1 11/2004 Morelli

* cited by examiner

*Primary Examiner* — Jason Skaarup
(74) *Attorney, Agent, or Firm* — Perkins Coie LLP

(57) ABSTRACT

A swing training system includes a base unit having a grapple that is movable between open and closed positions. A free end of an elongated swing device, such as a golf club or a hockey stick, is secured within the grapple. The swing device is manipulated to exert a force on the grapple and a load cell, away from the base unit, for a predetermined value, such as force and/or time. Relative movement between the grapple and the base is substantially limited while the swing device is manipulated. Once the predetermined value is attained, the grapple releases the free end of the swing device.

30 Claims, 7 Drawing Sheets

SWING TRAINING SYSTEM AND METHOD

BACKGROUND

The arced, downward swing of a golf club or hockey stick can be a difficult thing to do well. It requires an accurate, consistent arcing path. It also requires strength and muscle memory to complete a clean, powerful swing. Most golfers and hockey players train for years to attain a consistent, powerful swing. Over the years, many different training methods and tools have been developed to improve and strengthen golfers' and hockey players' swings. However, most methods and tools focus on the complete swing, from backswing through the follow-through. These methods and tools provide valuable training. However, they provide little in the way of focused training for individual aspects of the golfer's and hockey player's swing.

Many different muscle groups are used when a golfer or hockey player swings the club or stick. To be sure, a full swing will involve the arms, core and lower body of the athlete; all functioning together for each swing. The muscle groups shift as the club or stick moves through the back swing, then into the downswing, to the bottom of the swing arc, and through the backswing. Accordingly, different aspects of the muscle groups are used at the top of the swing from those used in the bottom of the swing or those used in the follow-through. Most athletes are able to improve their swing by repeatedly swinging the club or stick through the full swing arc. However, the swing can be further improved and strengthened where the swing is broken into smaller components. One component that is common to all swings of golf clubs and hockey sticks is the forward movement through the bottom quarter of the swing arc where the golf ball or puck is struck. In order to strengthen the muscle groups used in this particular portion of the swing, a system and method is required to repeatedly challenge the athlete in this small, focused aspect of the swing.

Unfortunately, athletes from professionals to amateurs lead busy lives that prevent the athletes from spending as much time as one would want at the golf course or hockey rink. Accordingly, a swing training system and method will need to be portable in order to receive the continued repetitions needed to develop strength and muscle memory. This may require the athlete to train indoors or outdoors, at home, in an office, or on the road. Along with portability, the system and method will need to be simple in construction and use. If the system requires many separate components, or is difficult or time consuming to set up and take down, the athlete will be less inclined to train with the necessary frequency.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

The present disclosure provides a swing training system that can be used for various sports, including golf and hockey. The system includes a base unit having a grapple that moves between open and closed positions. A load cell determines load data based on a load placed on the grapple. The system further includes a processor that is programmed to receive the load data from the load cell and signal the grapple to move into an open position when the load data has attained a predetermined value. In various embodiments, the predetermined value may be a predetermined load level over a period of time.

The system includes an elongated swing device having a gripping end portion and an opposite grapple engagement end portion, which is shaped to releasably engage the grapple. In some embodiments, the swing device is a golf club. In other embodiments, the swing device is a hockey stick. In some embodiments, the gripping end portion of the swing device includes a grapple engagement structure extending outwardly from the swing device. The grapple engagement structure shaped to be received within the grapple.

The base unit may include an anchor to restrain movement of the base unit. In some embodiments, the anchor includes an elongated tether, secured to the base unit. A free end of the tether includes a securement loop, stopper or other mechanism for securing the system to a static structure near the base unit. In other embodiments, spikes or the like are used to anchor the base unit with the ground.

In use, the base is secured to an operating surface, such as a floor or a ground surface. In some embodiments, the user selects a predetermined value, such as force, duration, or both. The grapple engagement end portion of the swing device is secured with the grapple extending from the base unit. The user may then grasp a grip end portion of the swing device while standing adjacent the base unit. The user manipulates the swing device so that the grapple engagement end portion of the swing device exerts a force on the grapple, in a direction away from the base unit. The force exerted on the grapple is maintained until the system determines that at least one predetermined value has been attained, at which point, the grapple releases the grapple end portion of the swing device.

These and other aspects of the present system and method will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Figure 1:
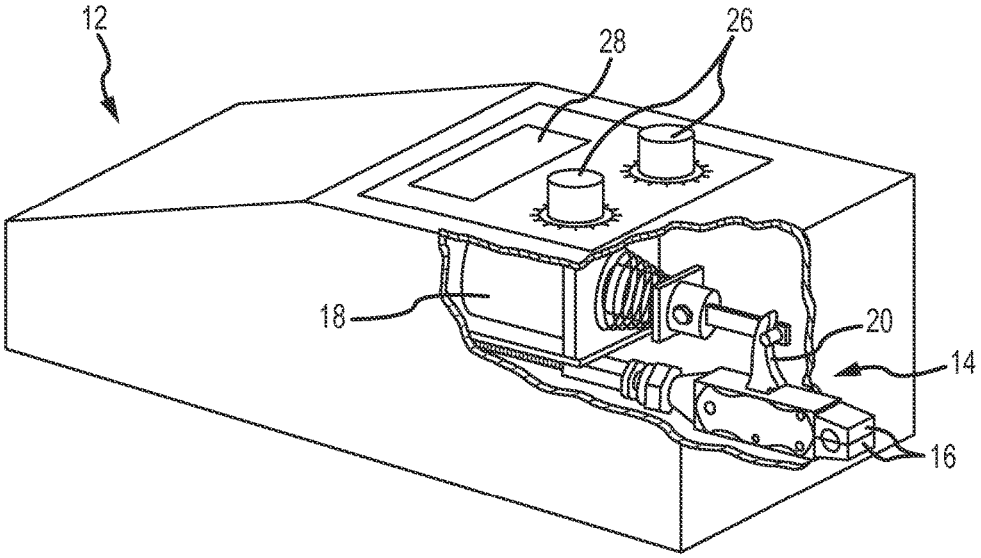
FIG. 1 depicts a perspective, cut-away view of one embodiment of a base unit that may be used with the swing training system of the present technology.
Figure 2:
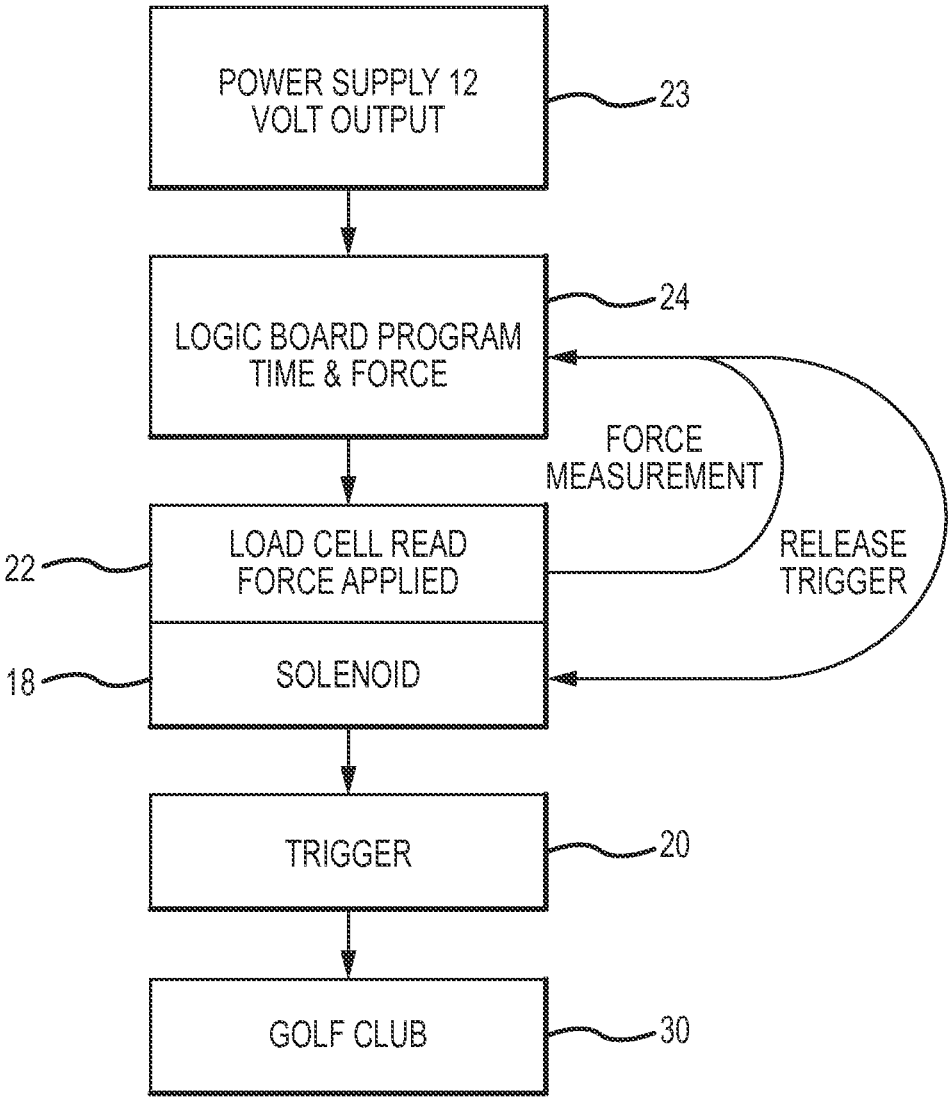
FIG. 2 depicts a schematic diagram of one embodiment of the swing trainer of the present technology.
Figure 3:
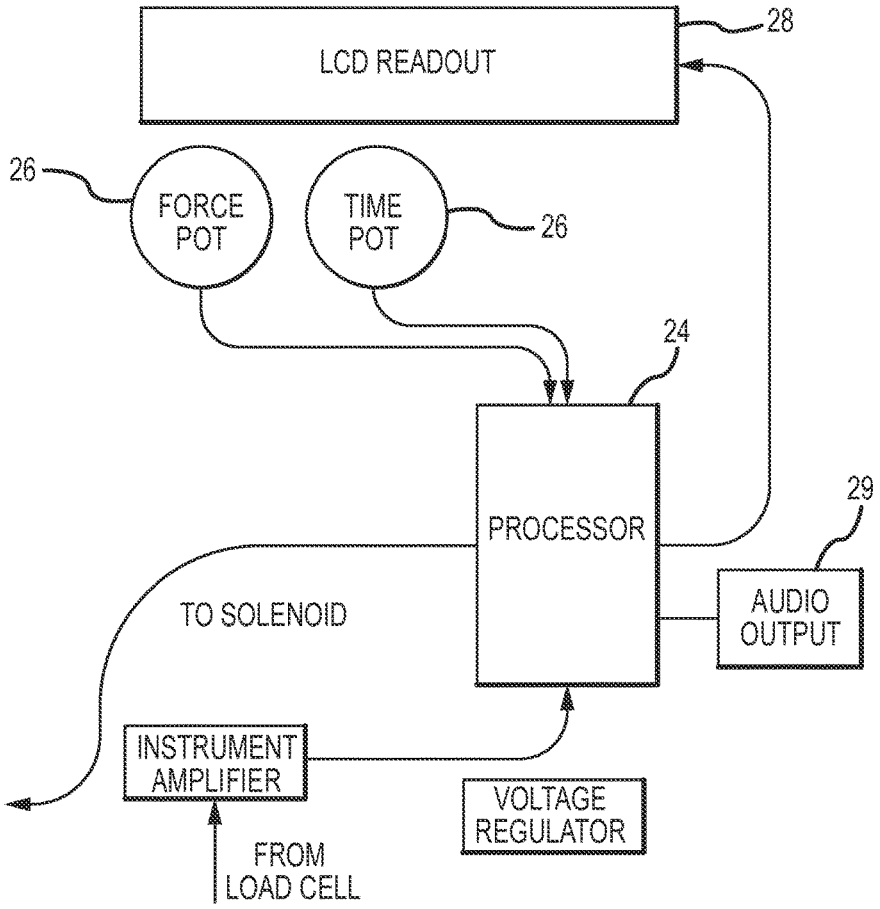
FIG. 3 depicts a partial electrical schematic of the base unit of the present technology.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

The present technology provides swing training systems and methods that develop muscle memory and strength for athletes in sports such as golf and hockey. Golf and hockey are used as exemplary sports that may benefit from the systems and methods of the present technology. However, nearly any sport or activity where the athlete swings a piece of equipment could benefit from the training principles of the present technology. In the exemplary embodiments disclosed herein, the systems and methods train the athlete in the specific area of the swing from about one foot prior to the bottom of the swing, such as where a golfer may place the golf ball, until impact with the ball. It is contemplated, however, that the present technology may be easily adapted to focus on other aspects of the athlete's swing without departing from the scope of the disclosed technology.

With reference to FIGS. 1-5, embodiments of a swing training system 10 are depicted. The system generally includes a base unit 12 having a grapple 14 that is selectively movable between open and closed positions. In some embodiments, the grapple 14 includes a pair of opposing grapple jaws 16 that are positioned in a spaced-apart configuration when the grapple is in the open position and are positioned at least closely adjacent one another when the grapple is in the closed position. In various embodiments, the grapple includes a solenoid 18 that is configured to move the grapple jaws 16 between the open and closed positions. A lever arm or trigger 20 may be coupled to the solenoid 18 and the grapple jaws 16. In particular embodiments, the trigger 20 is configured to receive input from the solenoid 18 and move the grapple jaws 16 between the open and closed positions in response to the solenoid input. In many embodiments, the grapple 14 is rigidly coupled with the base unit 12, such that relative movement between the grapple 14 and the base unit 12 is substantially limited. This is due to the limited aspect of the user's swing that is being trained. Little to no relative movement between the grapple 14 and the base unit 12 is implemented, as opposed to full swing trainers that require substantial relative movement between components of the training systems. While a grapple with opposing jaws is depicted, it is contemplated that other retention devices may be used, depending on the desired application of the swing training system 10, as discussed in greater detail below.

In various embodiments, the swing training system 10 includes a load cell 22 that is operatively coupled with the grapple 14. In some embodiments, the load cell 22 may be similar to those used in a digital scale. In embodiments of the present technology, the load cell 22 is positioned within the base unit 12 and placed in communication with the grapple 14. In this orientation, a pulling force exerted on a distal end portion of the grapple 14 will exert a measurable load on the load cell 22. The load cell 22 is provided to determine load data based on a load placed on the grapple 14. The electronics of the swing base unit 12 may be supplied with a power supply, such as a standard 12V power supply 23 that may be received from a cord associated with the base unit 12 that is plugged into a receptacle. It is further contemplated that the power may be supplied by one or more batteries associated with the base unit 12.

Embodiments of the swing training system 10 include a processor 24 within the base unit 12. The processor is placed in electronic communication with the load cell 22. Software is operative on the processor 24 to receive the load data from the load cell 22. The software is further operative on the processor 24 to signal the solenoid 18 within the grapple 14 to move the jaws 16 into an open position when the load data has attained a predetermined value. In some embodiments, the predetermined value equals a predetermined load level. For example, the processor 24 may be programmed to detect a particular load, such as five pounds of pull, ten pounds of pull, etc. In such embodiments, the processor may be programmed to move the jaws into an open position once a load of ten pounds of pull, for example, is detected by the load cell 22. In other embodiments, the predetermined value equals a predetermined load level over a period of time. For example, the processor 24 may be programmed to detect a particular sustained load, such as eight pounds of pull, or a range of such as five to ten pounds of pull, or eight pounds of pull and higher, for a period of time, such as five seconds. In at least one embodiment, athletes that are new to the related swing-based sport, or to this training method, may set the swing training system 10 to a goal of two pounds of force for a duration of two seconds. More advanced athletes may, for example, set the swing training system 10 to a goal of eight pounds for a duration of ten seconds.

In some embodiments, the swing training system 10 is provided to receive variable input from the user. For example, in particular embodiments, the software is operative on the processor 24 to receive variable input from a user to set a predetermined load level. Similarly, the software may be operative on the processor 24 to receive variable input from a user to set a period of time. In order to receive the variable input from the user, the base unit 12 includes inputs 26, which may be manipulated by the user to increase or decrease the predetermined values, such as the load level and period of time. The inputs are depicted as being knobs. However, any manner of receiving physical input, such as buttons, touchpads, and the like may be used. One or more displays 28 may be associated with the base unit 12 to provide a visual indication of the predetermined value and/or values attained by the user during one or more uses of the swing training system 10.

In at least some embodiments, the swing training system 10 includes one or more various audible feedback signals. For example, the base unit 12 may associate one or more audio outputs 29, such as a speaker, with the processor 24 and the software operative thereon. In at least one embodiment, the processor 24 may cause the audio output 29 to emit an audible signal, such as a buzzer, bells, music, words of encouragement, or the like, when a predetermined amount of force is applied by the athlete. In some embodiments, the audible signal may be constant, so long as the predetermined level of force or higher is being applied. Where the application of force drops below the predetermined level the audible signal may stop or change to a different audible signal, advising that the exercise requirements are not being met. In such situations, the processor 24 could reset the predetermined amount of time that the predetermined amount of force is to be applied. This will encourage the athlete to continue to try until the predetermined goals are met. Still another audible signal when the predetermined force has been applied for a predetermined amount of time.

In various embodiments of the swing training system 10, an elongated swing device 30 is used with the base unit 12. Many swing devices 30 include a gripping end portion 32 and an opposite grapple engagement end portion 33 that is shaped to releasably engage the grapple 14 in its closed position. It is contemplated that, in some embodiments, the swing device 30 will be a golf club. The golf club may be a wood, iron, or putter. The choice of the type of club may, at least, partially dictate the predetermined values used. In other embodiments, the swing device may be a hockey stick or other piece of equipment that is typically swung in the course of its use. Regardless of the type of swing device 30 used, the grapple engagement end portion 33 of the swing device 30 will releasably engage the grapple 14. In various embodiments, the grapple engagement end portion 33 includes a grapple engagement structure 34 that extends outwardly from the swing device 30. The grapple engagement structure 34 is shaped to be received within the grapple 14. For example, the grapple engagement structure 34 may be provided as a loop formed by a rigid loop bar that is shaped to be securably received between the jaws 16 of the grapple 14. In particular embodiments, the loop may be a metal loop that is welded to the rearward face of an iron or other golf club. It is contemplated that either or both of the grapple 14 and the gripping engagement structure 34 may be provided using substitute structures, according to the desired use of the swing training system 10. For example, the connection may include one of various mechanical couplings, such as ball and socket, post and receptacle, hook and loop, and the like. Similarly, the connection may be made electric in nature, such as through an electrically powered magnetic connection. Such mechanical and electric variations could be variable in the connection strength and duration.

Figure 4A:
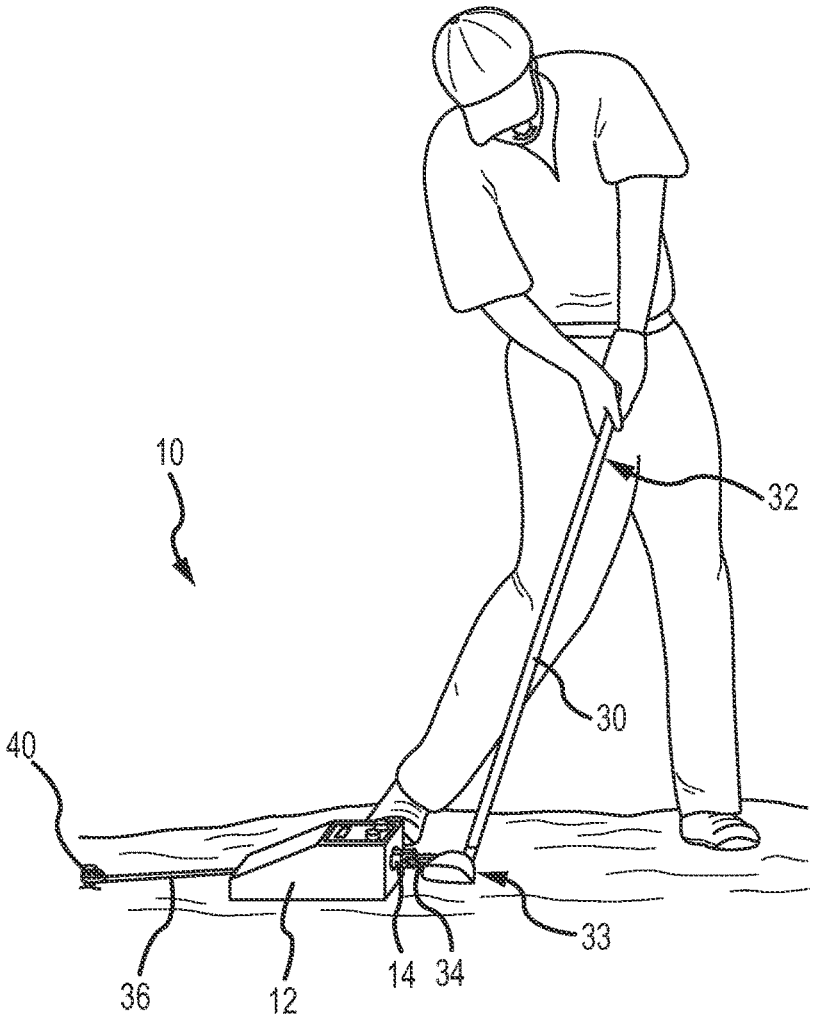
FIG. 4A depicts one manner in which a user may employ one type of swing device with a base unit of the present technology in a load-inducing aspect of one training method.
Figure 4B:
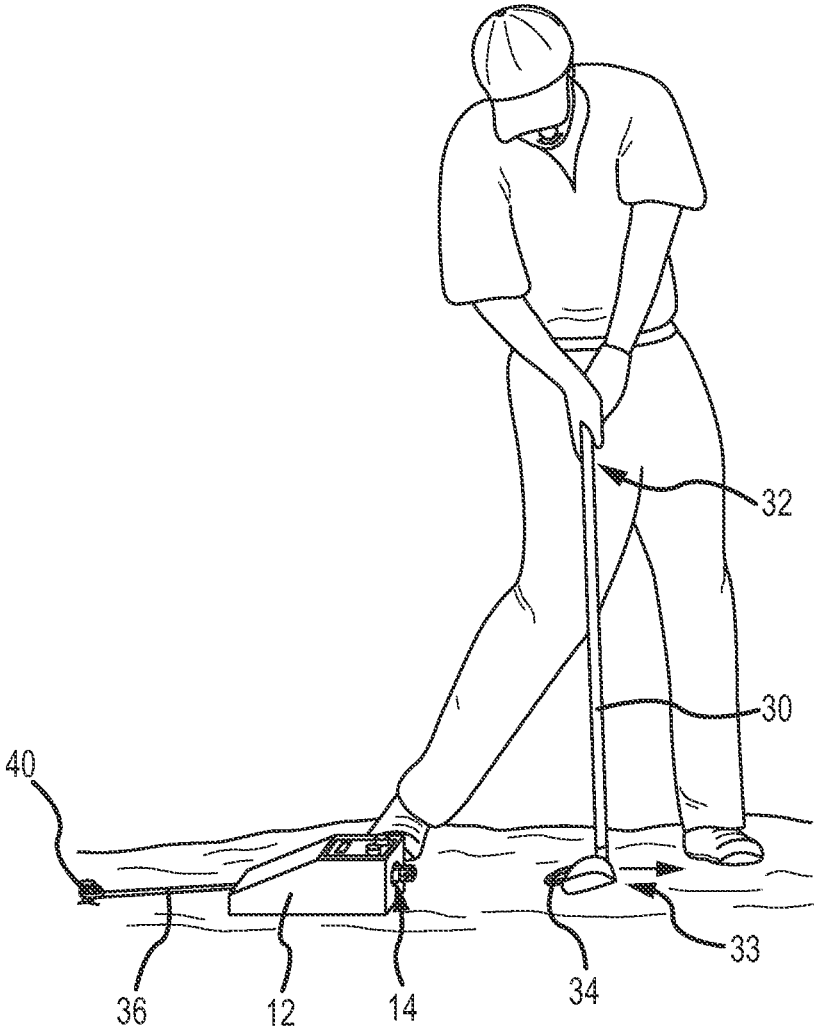
FIG. 4B depicts one manner in which the base unit of FIG. 4A may release the swing device after completing the load-inducing aspect of the training method of FIG. 4A.
Figure 5A:
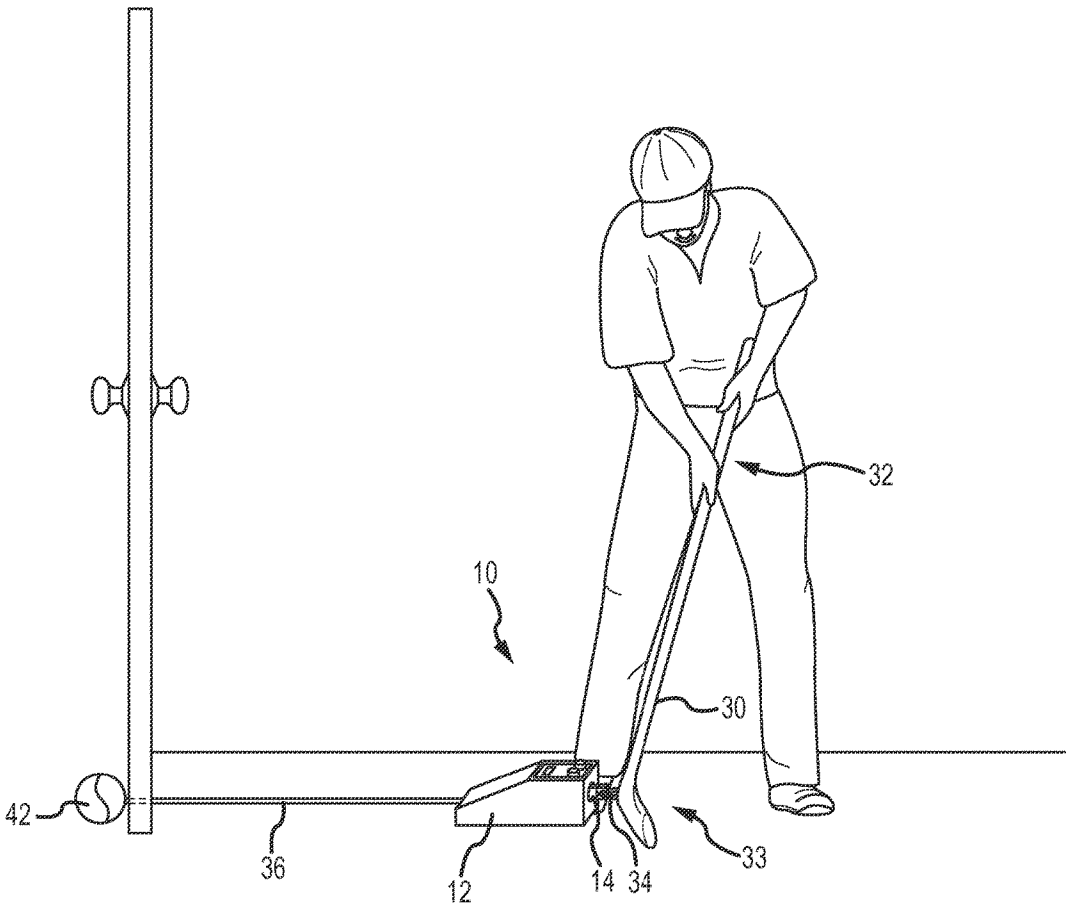
FIG. 5A depicts another manner in which a user may employ one type of swing device with a base unit of the present technology in a load-inducing aspect of one training method.
Figure 5B:
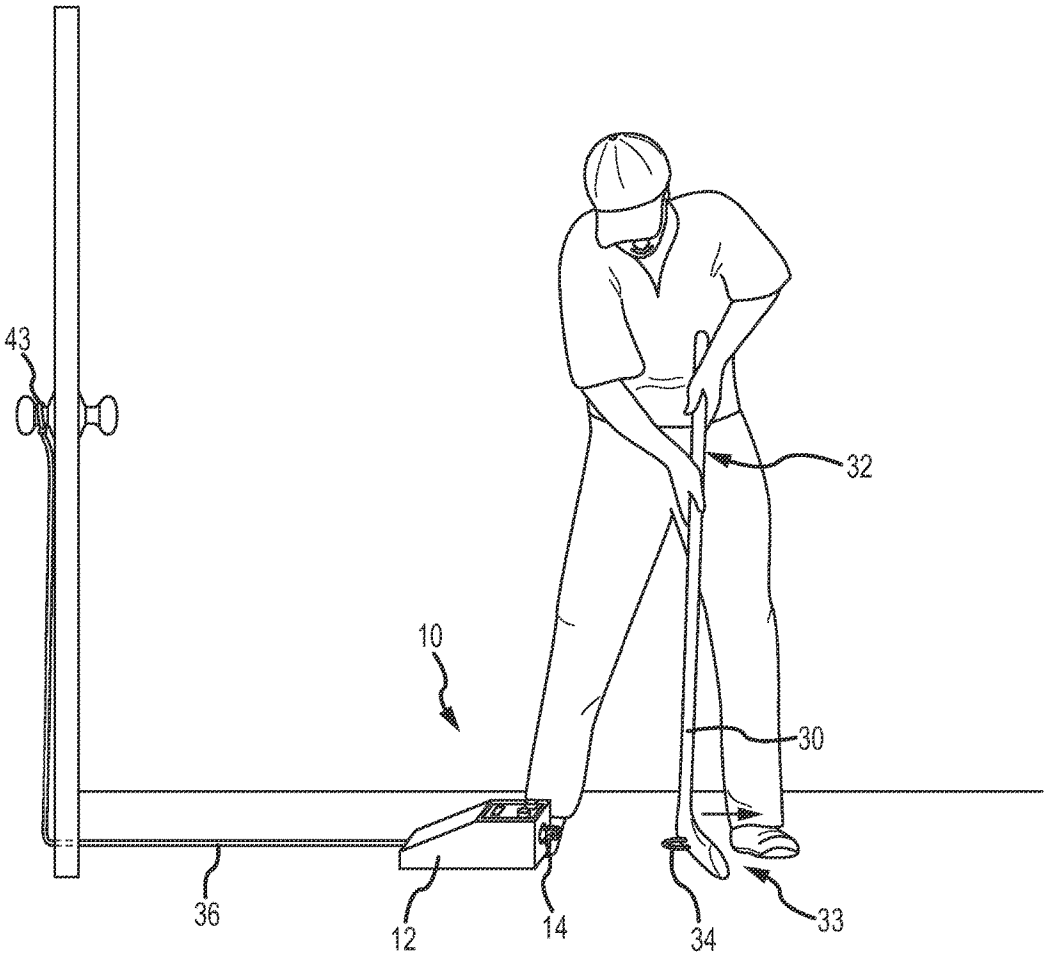
FIG. 5B depicts one manner in which the base unit of FIG. 5A may release the swing device after completing the load-inducing aspect of the training method of FIG. 5A.

Various embodiments of the present technology provide the swing training system in a compact form that allow it to be portable and easily stored. Accordingly, embodiments of the base unit 12 may have an insufficient weight to overcome the pulling force exerted by the user. Accordingly, embodiments of the present technology provide the base unit 12 with an anchor to restrain movement of the base unit when it is in use. With reference to FIGS. 4A-5, various embodiments of the anchor include an elongated tether, secured at a first end to the base unit 12. In many embodiments, the tether may be provided as a lightweight cordage of various compositions that is sufficiently flexible for storage and transport but sufficiently strong to overcome the pulling forces exerted on the base unit 12. In some embodiments, a second end portion of the tether includes a securement loop 38. The securement loop 38 may be secured with nearly any static structure of sufficient mass to restrain the base unit 12 during use. For example, the securement loop may be secured to a doorknob, leg of a bed or table, etc. In other embodiments, depicted in FIGS. 4A and 4B, the second end portion of the tether 36 may be provided with a spike 40 that may be driven beneath a ground layer. With reference to FIG. 5A, the second end portion of the tether 36 may be provided with a stopper 42, such as a ball-like structure or even a knot formed in the tether 36, having a width that is larger than a width of the tether 36. In such embodiments, the stopper 42 may be positioned on the other side of a door that is closed, with the tether 36 running beneath the door. With reference to FIG. 5B, the second end portion of the tether 36 may be provided with a securement loop 43, which may be positioned on the other side of a door that is closed, with the tether 36 running beneath the door and the securement loop 43 being secured to the doorknob on the opposite side of the door.

In one method of use, the user may secure the base unit 12 to the ground or an adjacent structure using an anchor, such as the tether 36 or spike 40. A grapple engagement end portion 33 of an elongated swing device 30 is secured with the grapple 14 that extends from the base unit 12. With reference to FIG. 4A, the user grasps a grip end portion 32 of the swing device 30 while standing adjacent the base unit 12. The user then manipulates the swing device 30 so that the grapple engagement end portion 33 of the swing device 30 exerts a pulling force on the grapple 14 and load cell 22, in a direction away from the base unit. The manipulation step mimics the user's swing at the bottom of the swing arc, prior to where a ball (or other object, such as a puck) would be positioned during a normal or "live" swing. This may be one of various distances "behind the ball," such as six inches, twelve inches, eighteen inches, etc. As the distance "behind the ball" changes, the exercise of pulling the swing device 30 away from the base unit 12 stresses the user's muscle groups in a slightly different manner. Accordingly, a complete training session may include repeated uses of the swing training system at different positions "behind the ball." The user maintains the force exerted on the grapple 14 until the processor 24 determines that at least one predetermined value has been attained, at which time the grapple 16 releases the grapple engagement end portion 33 of the swing device 30. Throughout the training exercise, relative movement between the grapple 14 and the base unit 12 is substantially limited during the step of manipulating the swing device 30. This helps to isolate the aspect of the swing being mimicked by the swing training device.

As discussed previously, the user may set the predetermined value by setting a predetermined load level to be exerted on the load cell 22, through adjustment of at least one input 26. In some embodiments, the predetermined value is set by the user as a predetermined period of time during which the load level is to be exerted on the load cell. Again, the load and duration of time settings may be manually set by the user through manipulation of one or more inputs 26. It is contemplated that a number of different pre-set loads and/or duration times may be preloaded on the processor 24 and automatically presented to the user, as a set training routine, manually selected by the user.

Although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A swing training system, the system comprising:

an elongated swing device having a gripping end portion and an opposite grapple engagement end portion;

a base unit including a grapple that is selectively movable between open and closed positions, wherein the grapple is configured to retain the grapple engagement end portion of the elongated swing device when the grapple is in the closed position and release the grapple engagement end portion when the grapple is in the open position;

a load cell operatively coupled with the grapple; the load cell configured to determine load data based on a load placed on the grapple when the engagement end portion of the elongated swing device is retained by the grapple; and a processor operatively coupled with the load cell and the grapple;

the processor being programmed to receive the load data from the load cell, determine if the load data has attained a predetermined value, and cause the grapple to move into an open position to release the grapple engagement end portion when the load data has attained the predetermined value.

2. The system of claim 1 wherein:

the opposite grapple engagement end portion is shaped to releasably engage the grapple in its closed position.

3. The system of claim 1 wherein:

the grapple engagement end portion of the swing device includes a grapple engagement structure extending outwardly from the swing device; the grapple engagement structure shaped to be received within the grapple.

4. The system of claim 3 wherein:

the grapple engagement structure is a loop formed by a loop bar.

5. The system of claim 3 wherein:

the swing device is a golf club.

6. The system of claim 3 wherein:

the swing device is a hockey stick.

7. The system of claim 1 wherein:

the grapple includes a pair of opposing grapple jaws that are positioned in a spaced-apart configuration when the grapple is in the open position and are positioned adjacent one another when the grapple is in the closed position.

8. The system of claim 7 wherein:

the grapple includes a solenoid configured to move the grapple jaws between the open and closed positions.

9. The system of claim 8 wherein:

the grapple further includes a trigger operatively coupled with the solenoid and the grapple jaws; the trigger configured to receive input from the solenoid and move the grapple jaws between the open and closed positions in response to the input from the solenoid.

10. The system of claim 1 wherein:

the predetermined value equals a predetermined load level.

11. The system of claim 1 wherein:

the predetermined value equals a predetermined load level over a period of time.

12. The system of claim 11 wherein:

the processor is programmed to receive variable input from a user to set the predetermined load level.

13. The system of claim 11 wherein:

the processor is programmed to receive variable input from a user to set the period of time.

14. The system of claim 1 wherein:

the processor is programmed to cause an audio output to emit a first audible signal when the predetermined load level is achieved.

15. The system of claim 14 wherein:

the processor is programmed to cause the audio output to emit a second audible signal when the predetermined load level is achieved for a predetermined amount of time.

16. The system of claim 14 wherein:

the processor is programmed to cause the audio output to emit a third audible signal when the predetermined load level is achieved for less than a predetermined amount of time.

17. The system of claim 1 wherein:

the base unit includes an anchor configured to restrain movement of the base unit.

18. The system of claim 17 wherein:

the anchor includes an elongated tether, secured at a first end of the tether to the base unit.

19. The system of claim 18 wherein:

a second end portion of the tether includes a securement loop.

20. The system of claim 18 wherein:

a second end portion of the tether includes a stopper having a width that is larger than a width of the tether.

21. The system of claim 18 wherein:

the anchor includes at least one spike, operatively coupled with the base unit and configured to be driven beneath a ground surface.

22. The system of claim 1 wherein:

the grapple is rigidly coupled with the base unit such that relative movement between the grapple and the base unit is substantially limited.

23. A method of swing training, the method comprising:

securing a grapple engagement end portion of an elongated swing device with a grapple that is operatively coupled with a base unit; the grapple being selectively movable between open and closed positions that releases and secures the grapple engagement end portion of the swing device, respectively;

grasping a grip end portion of the swing device while standing adjacent the base unit;

manipulating the swing device so that the grapple engagement end portion of the swing device exerts a load on the grapple and a load cell, in a direction away from the base unit, while being secured by the grapple;

maintaining the load exerted on the grapple and load cell until a processor, operatively coupled with the load cell and the grapple, determines that at least one predetermined value of the load has been attained and causes the grapple to move from the closed position to the open position and release the grapple engagement end portion of the swing device based on the determination.

24. The method of claim 23 wherein:

the predetermined value is determined by setting a predetermined load level to be exerted on the load cell.

25. The method of claim 24 wherein:

the predetermined value is further determined by setting a predetermined period of time during which the load level is to be exerted on the load cell.

26. The method of claim 23 wherein:

the step of securing a grapple engagement end portion of an elongated swing device with a grapple includes positioning a grapple engagement structure extending outwardly from the swing device in engagement with the grapple.

27. The method of claim 23 further comprising:

anchoring the base unit with a static structure adjacent the base unit prior to manipulating the swing device.

28. The method of claim 27 wherein:

the step of anchoring the base unit with a static structure includes securing a free end of a tether, extending from the base unit, with the static structure.

29. The method of claim 27 wherein:

the step of anchoring the base unit with a static structure includes securing a spike, which is operatively coupled with the base unit, within a ground layer.

30. The method of claim 23 wherein:

the grapple is rigidly coupled with the base unit such that relative movement between the grapple and the base unit is substantially limited during the step of manipulating the swing device.

* * * * *